US005205670A

United States Patent [19]

Hill

[11] Patent Number: 5,205,670

[45] Date of Patent: Apr. 27, 1993

[54] ROTATING SURFING WAVE SIMULATOR

[76] Inventor: Kenneth D. Hill, 58-025 Kapuai Pl., Haleiwa, Hi. 96712

[21] Appl. No.: 754,633

[22] Filed: Sep. 4, 1991

[51] Int. Cl.[5] ..... E02B 3/00; E04H 3/18

[52] U.S. Cl. ..... 405/79; 405/52; 472/13

[58] Field of Search ..... 405/79, 52, 80; 472/13, 472/16, 128

[56] References Cited

U.S. PATENT DOCUMENTS

| | | | |
|---|---|---|---|
| 765,093 | 7/1904 | Miller | 472/13 |
| 1,076,779 | 10/1913 | Miller et al. | 472/13 |
| 1,143,352 | 6/1915 | Boecker | 472/13 X |
| 1,701,842 | 2/1929 | Fisch | 472/128 X |
| 2,815,951 | 12/1957 | Baldanza . | |
| 3,125,339 | 3/1964 | Nielsen . | |
| 3,598,402 | 8/1971 | Frenzi . | |
| 3,635,448 | 1/1972 | Okada . | |
| 3,820,760 | 6/1974 | Milik . | |
| 3,913,332 | 10/1975 | Forsman . | |
| 4,301,717 | 11/1981 | Knees . | |
| 4,954,014 | 9/1990 | Sauerbier et al. . | |
| 4,986,784 | 1/1991 | French . | |

FOREIGN PATENT DOCUMENTS

| | | | |
|---|---|---|---|
| 0041392 | 3/1977 | Japan | 405/79 |

*Primary Examiner*—Dennis L. Taylor

*Attorney, Agent, or Firm*—Watson, Cole, Grindle & Watson

[57] ABSTRACT

A wave simulator comprises a circular pool containing a volume of water which rotates about a central axis. The pool is rotatably mounted on a truck bed so that transportation of the wave simulator is facilitated. A surf craft is movably attached to a stationary structure so that a surf craft rider may practice the sport of surfing within the simulator.

27 Claims, 6 Drawing Sheets

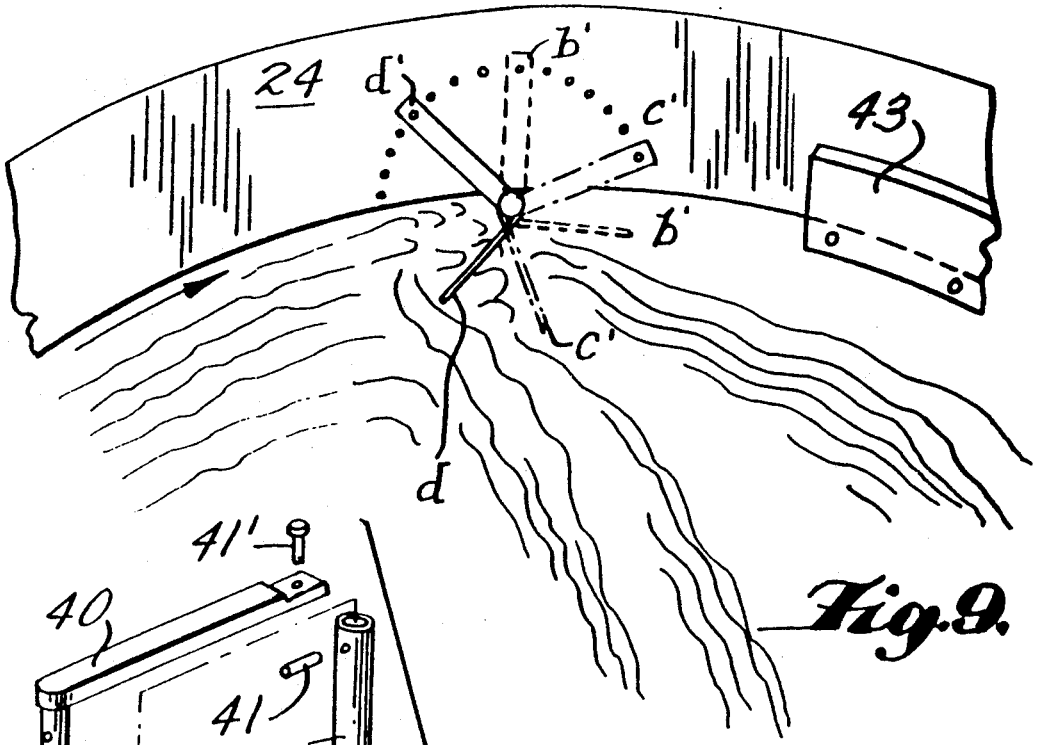
Fig. 9.
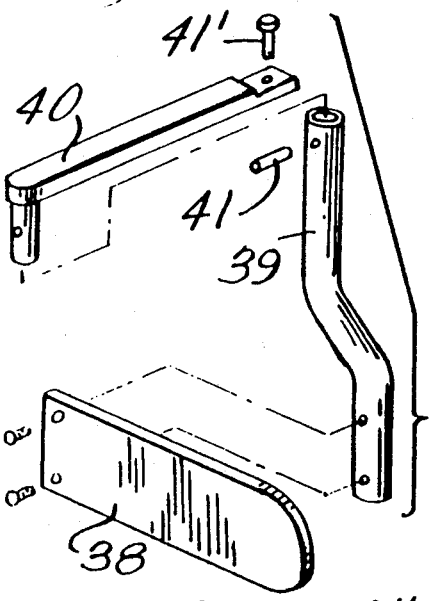
Fig. 10.
Fig. 12.
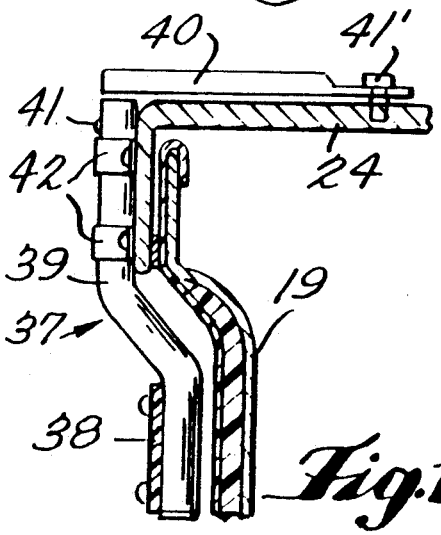
Fig. 11.
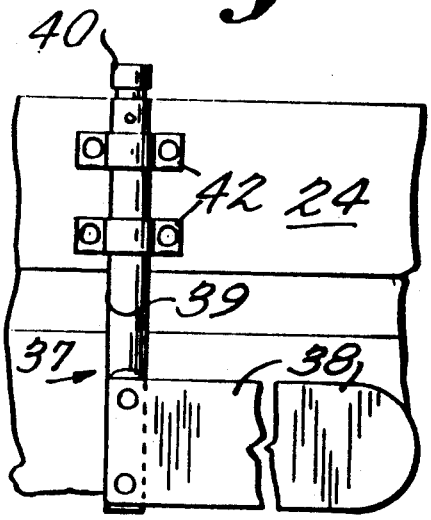

ROTATING SURFING WAVE SIMULATOR

FIELD OF THE INVENTION

The present invention relates to an improvement in artificial wave generating pools, and, more specifically, to a novel means for producing a circular standing wave for recreational use by surf riders, both prone (known as body boarders) and stand-up ("traditional") surfers.

BACKGROUND OF THE INVENTION

Many pools have been constructed for the purpose of creating artificial surfing breakers. These pools are, however, limited in that they require sizable areas in which to operate and a large investment in motors, pumps and caissons. Also, once a site is chosen and the wave pool constructed, there is no viable or expedient means for dismantling and transporting the pool if desired.

SUMMARY OF THE INVENTION

It is an object of the invention to provide a more economical device for producing surfing waves in a compact area, and to make the device portable by design. The invention realizes this object by taking advantage of the laws of centrifugal force.

According to one aspect of the present invention, a rotatable circular platform is mounted to a truck bed and a circular pool is mounted in turn to the platform. With additional hardware and the use of a motor and drive system, the pool is rotated at sufficient speed so as to cause a specified volume of water within the pool to move in the direction of rotation. The centrifugal force acting on the rotating flow causes it to bend and rise, giving it the slope, crest, trough and velocity of a surfable wave. The addition of a board attachment means and safety nets allows surf riding to be performed within the simulator. The investment and space required for such a system is considerably less than other wave pools in existence.

Another object of the invention is to simulate ideal surfing waves for both novice and expert riders, with the waves possessing a shape and surface quality previously unattainable outside the natural confines of the ocean.

Still another object of the present invention is to provide a standing rotary wave that does not diminish in size or quality with the passage of time, thus providing riders with a prolonged surfing duration.

Yet another object of the invention is to produce waves of a size, power and magnitude heretofore unknown to devices of this nature, and naturally found only in remote areas. Such waves are created only when very specific conditions are manifest, such as swell size and direction, reef slope and depth. Surf riders previously had to travel great distances to such locations as Indonesia and more notably the North shore of the Hawaiian Island Oahu to find and ride such breakers. Such waves usually encompass a height of ten feet or more from trough to crest, and are prized by master surfriders for the challenge and thrill that accompany riding surf of this nature.

BRIEF DESCRIPTION OF THE DRAWINGS

These and other objects and features of the invention will be better understood from the following detailed description with reference to the accompanying drawings, wherein:

FIG. 9 shows the effect on the wave form of the various crest baffle positions; and FIGS. 10–12 show various embodiments of the crest baffle and its mounting means according to the present invention.

DETAILED DESCRIPTION OF PREFERRED EMBODIMENTS

Figure 1:
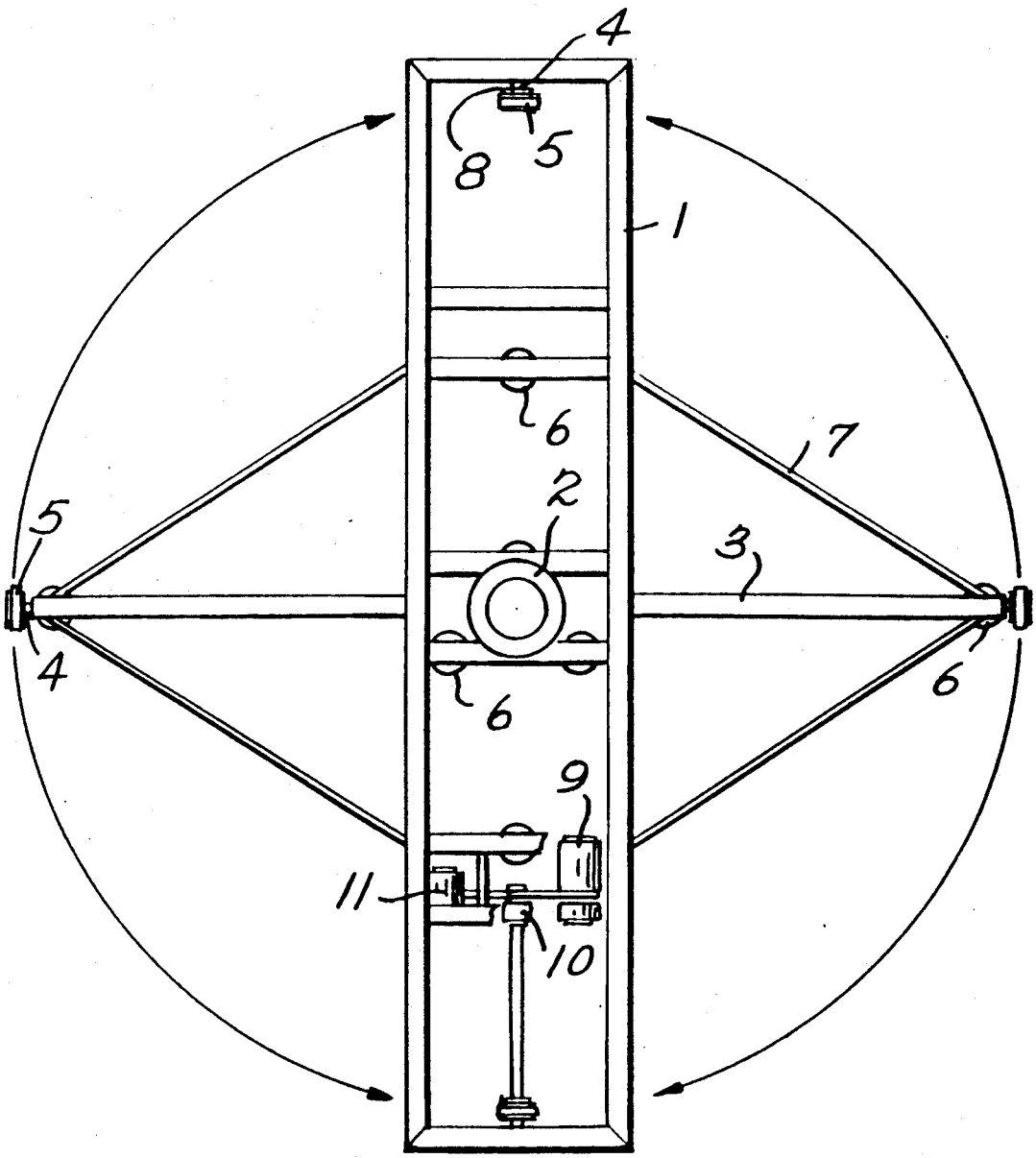
FIG. 1 is a top view of the support and drive system of the invention.

Referring to the drawings, a standard truck bed 1 is provided having normal dimensions and structure. The bed is positioned in an area suitable to the simulator's unfolded dimensions. A hub 2 of suitable materials, load bearing capacity and rotational integrity is mounted at the central area of the bed for rotation with respect thereto. A circular platform 15 is supported on the upper surface of the hub. Retractable beams 3 may be hinged on the truck bed on opposite sides of the hub 2 and are movable between a vertical stored position and a horizontal deployed position. Wheel mounts 4 are bolted or welded to the outer ends of the beams 3, and circumferential support tires 5 are rotatably mounted on the wheel mounts. Industrial-grade support jacks 6 are placed at spaced points underneath both the truck bed 1 and retractable beams 3 when the simulator is disposed in operative position. These jacks bear load and, in conjunction with support posts 7, serve to stabilize the under carriage of the simulator. Wood blocks or other like objects may be placed under the jacks as needed to level the simulator. A braking system 8 is provided on one or more tires as needed. Standardized automotive braking systems are suitable in this capacity.

A drive motor 9 of adequate horsepower, a reduction gear 10, and a split-phase gear motor 11 to provide varying speeds and reverse drive are welded or bolted as shown to the bed and, in conjunction with drive shaft 12, serve to rotate friction drive wheel 13. The friction drive wheel necessarily has a sturdier mounting to truck bed 1 than the support tires 5 but is of the same nature and size as tires 5. The drive system can be configured to allow for clockwise or counter-clockwise rotation by control of the split-phase gear motor.

Figure 2:
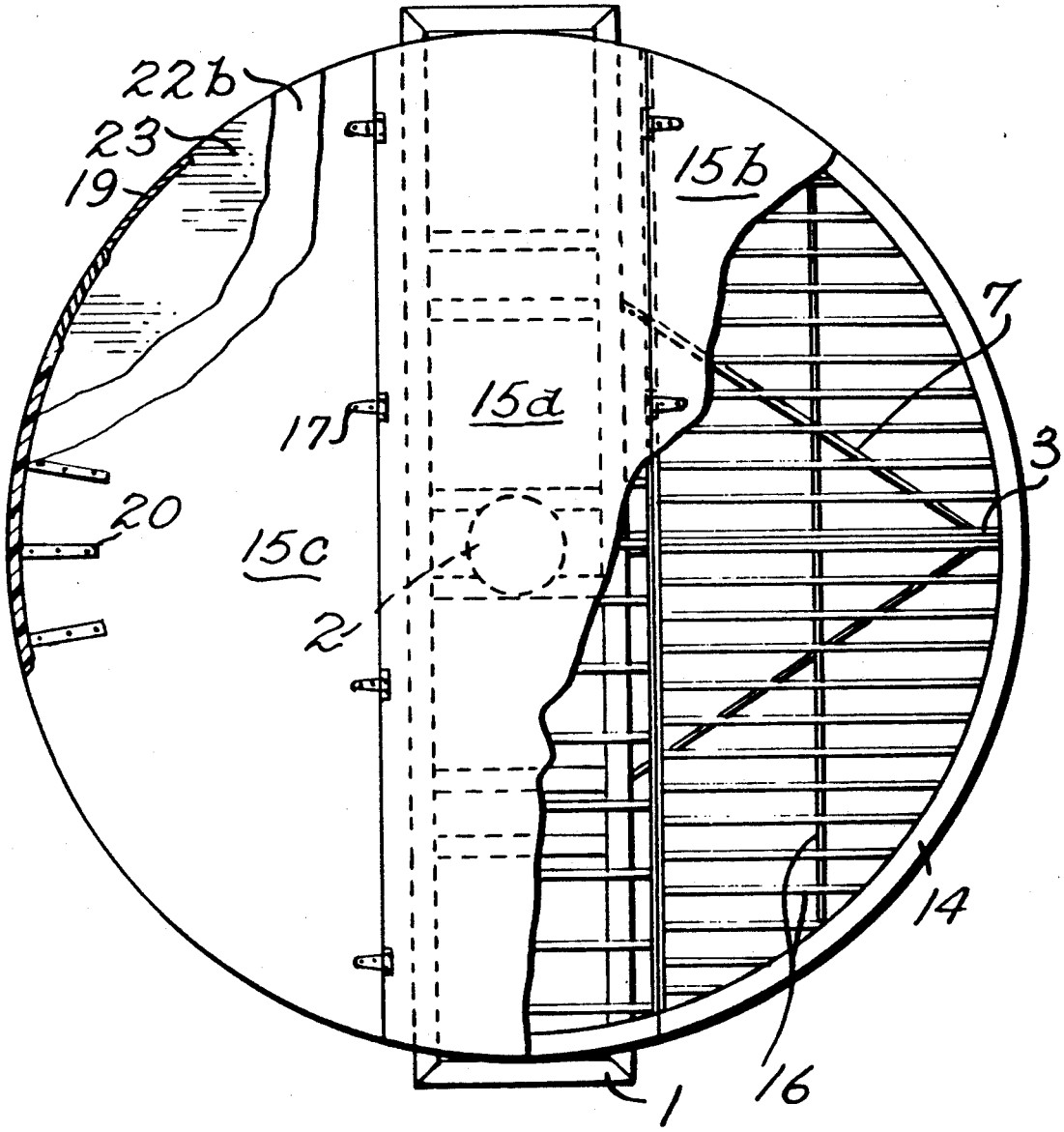
FIG. 2 is a top view of the rotatable platform shown as a partial-cutaway.
Figure 3:
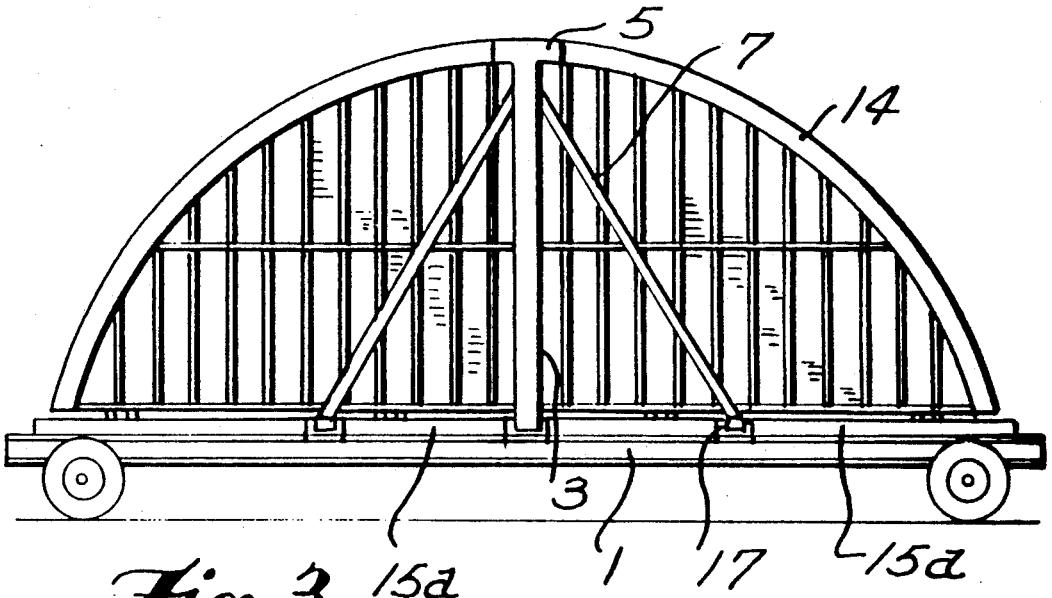
FIG. 3 is a side view of the platform and the support structure therefor in its folded position mounted on a truck bed.

A circular platform 15 is formed of a strong metallic substance such as steel and includes a central portion 15*a*, which is generally rectangular in configuration, and a pair of generally semi-circular side portions 15*b* and 15*c* each of which has a linear edge thereof pivotally attached to one of the linear sides of the central portion by hinges 17. The side portion may be moved into a vertical storage position as shown in FIG. 3 or moved into a horizontal operative position as shown in FIGS. 2 and 4a. Support members 16 are formed of material similar to that of portions 15a, 15b and 15c and are secured as by welding to the undersurfaces thereof to strengthen the platform. A drive ring 14 also formed of steel or the like is formed of circular segments secured as by welding to the peripheral portions of the undersurfaces of members 15a, b and c to define a complete circular drive ring when the device is in operative position.

As seen more clearly in FIGS. 2, 3 and 4a, the system serves to support and rotate a circumferential drive ring 14 made of a suitable rigid material. The ring is bolted, welded or otherwise secured to the underside of the circular platform 15, which is further supported along the underside by members 16 which are made of similar material and affixed in like manner. The platform and drive ring are preferably made compact atop truck bed 1 for transportational purposes by the segmentation of the platform along lines a'. The segments 15b, 15c are secured to the centrally disposed section 15a by industrial hinges 17, so that the resulting crescent-shaped sections 15b, 15c can be pulled up and secured by locking means, perpendicular to truck bed 1, as shown in FIG. 3. This embodiment, along with other facets of the invention's design, serve to make the device transportational as desired. Of course, other infrastructure designs may be implemented, such as a waterpark design wherein the unit would be permanently mounted in one location. Additionally, circumferential partition 18 may be implemented to cosmetically hide the underworkings of the simulator.

Figure 4B:
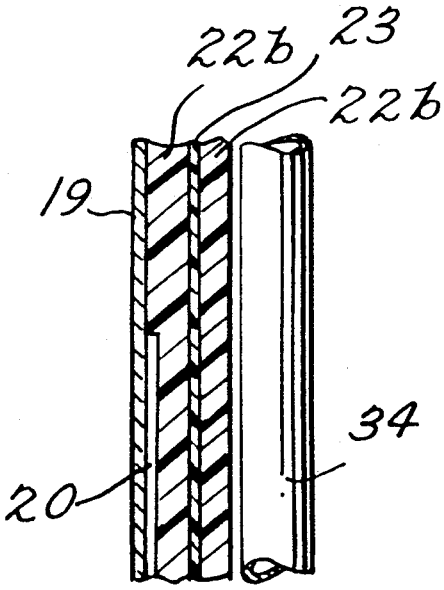
FIGS. 4*b* and 4*c* are enlarged detailed portions of the structure shown in FIG. 4*a;*
Figure 4C:
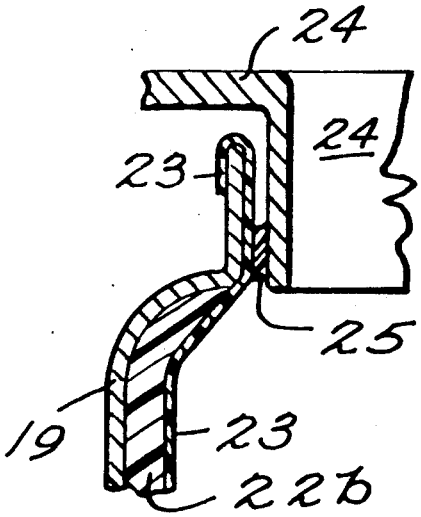
Figure 4A:
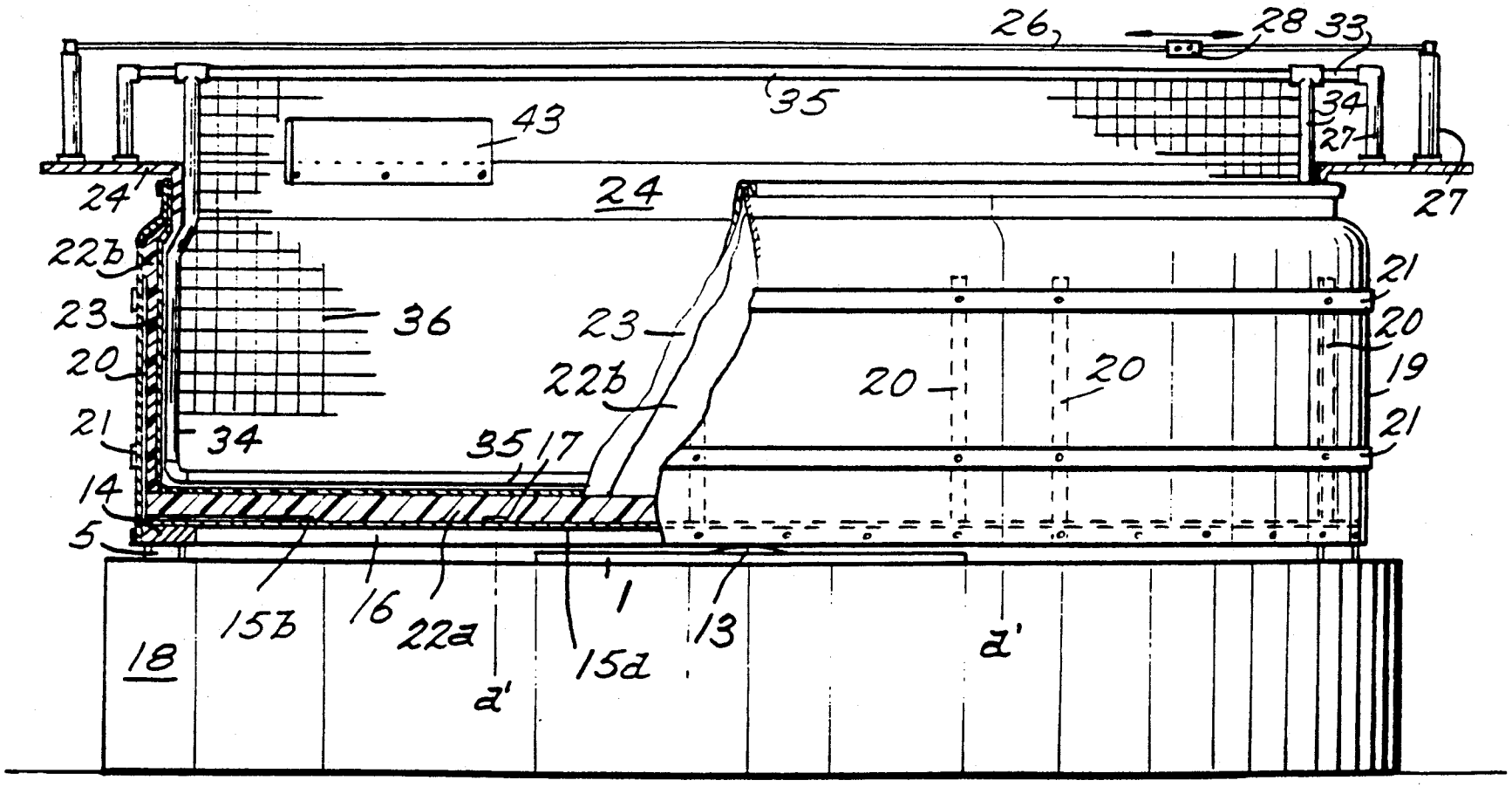
FIG. 4*a* is a side, partial-cutaway view of the pool and platform according to the invention.

As seen in FIGS. 4a-4c a multiplicity of "Doughboy"-style pool wall sections 19 can be secured to the mainframe in the following manner. Inner L-brackets 20 are welded to each section 19 and the horizontally disposed portion of the bracket is in turn securely bolted to the surface of circular platform 15. The lower portion of each vertical portion of the bracket is in turn secured in like manner to the outer periphery of circumferential drive ring 14 as is the lower portion of the pool wall 19. When completed, a container for holding the body of water, herein referred to as the pool, is formed. Additionally, outer retention bands 21 may be secured to the pool's upper and lower circumferences to preserve the necessarily round shape of the assembled pool wall when the simulator is rotating.

Horizontal padding 22a is installed on the surface of the platform 15 and is assembled in pie- or crescent-shaped pieces so that the whole of padding 22a fits flush along the inner periphery of the assembled pool wall. Vertical wall padding 22b is also installed for rider safety. The padding may be of any suitable type such as inflatable sections, expanded foam or alternate materials, and may be secured to the platform and pool wall by well-known means such as hook and loop (Velcro TM) fastening strips, clips or other viable means.

Paddings 22a and 22b may be molded or otherwise shaped so as to affect flow shape in a specific manner, i.e. a pond or multiple flume shape could easily be fabricated by implementing the appropriate shaped padding. Such alterations of pool shape may be employed to positively modify resultant simulator flow shape.

A fitted pool liner 23, made of polypropylene, vinyl or other suitable material is then fitted within the simulator and secured to the upper rim of pool the wall 19 by suitable means, such as clips, retention copings or grommet and pin devices (not shown). A water line, which would normally mark one-quarter to one-third of the simulator's total potential volume, may be embossed upon the liner's inner surface for precision filling of the simulator.

A raised pool deck 24 is provided around the circumference of the simulator. The deck is made of suitable materials preferably having a non-skid surface texturing. Pool deck 24 is elevated by normal means, such as legs or scaffolding with stairs (not shown) provided for user access. As shown in FIGS. 4a and 4c, the upper circumference of the pool wall closely underlaps the vertically disposed circumferential area of pool deck 24 so as to eliminate the possibility of individual injury that would occur should the upper edge of the wall be exposed, allowing surf riders to grab, fall upon or otherwise come in contact with the rotating pool edge. A safety stripping 25, made of thin plastic, rubber or other material further inhibits the likelihood of injury. The stripping lines the gap between the pool wall 19 and the vertically disposed lip area of deck 24. As shown in the drawings, the pool shape just underneath the pool/deck juncture is noticeably curved. The curvature is provided to prevent the centrifugally created wave shaped flow from swirling out of the simulator upon rotation. Additionally, a drain plug (not shown) may be secured within the simulator to expedite the removal of pool volume when necessary.

The pool structure may alternatively comprise a reinforced fiberglass pool and the driving means may comprise a chain or belt drive system.

The present invention does not, technically, create a wave (i.e. the propagation from point to point of a disturbance or oscillation), but is employed to simulate the general shape and physical attributes necessary for the surf riding sport to be practiced thereon. These attributes include, but are not limited to, flow velocity, trough, crest and the resulting inclined surface between the trough and the crest on a body of water known as a "wave", per se. Additionally, the invention introduces a new type of surfing wave by applying the laws of centrifugal force and the action the force has on a body of water in a circular pool structure. Normally, surfing waves and/or artificially-generated flows for similar purposes possess a shape and dimensions usually having the following characteristics: 1) the wave/flow embodies an inclined surface wherein movement of flow is primarily from trough-to-crest, in that order; and 2) individuals riding on such a wave/flow are normally in a state of motion across the inclined surface of the wave/flow, so that the surf rider's original point of catching the wave/flow versus the point he ceases from riding the wave/flow is at a distance proportional to the length of time the surfer rode the wave/flow and the forward momentum of the wave, etc. In other words, the surf rider, in the act of riding the wave/flow, travels a distance from his original point of departure, and the surfing action is dependent on both the forward movement of the wave/flow and the trough-to-crest flow action, allowing the rider to slide up and down the inclined wave/flow surface as it moves shoreward. The present invention proposes that, if an inclined surface is provided and flow is in a non-traditional direction, a surf rider may mount a surfing craft, as will become apparent later, and ride the aforementioned inclined surface with no forward momentum, but in a side-to-side (trough-to-crest) fashion. The invention realizes this object by rotating the simulator to cause the horizontally disposed water volume within the simulator to move in the direction of rotation. Due to the centrifugal force imposed upon the volume, the volume rises and bends, thus creating a wave shaped inclined body of water. The wave-shaped flow is mostly free of the turbulence associated with surfing waves as the system does not create any "whitewater". Additionally, the deck and recessed nature of the pool keep wind from disturbing the flow, thus giving the flow an outstanding shape and surface quality.

A preferred ratio of simulator radius to wall height is approximately 2:1. Taking into account the wave shaped flow created within the confines of the simulator, this ratio facilitates the creation of ridable flows of a size and magnitude previously unattainable outside the ocean, i.e. Radius=20 feet and height=10 feet. Other ratios are of course possible and can create other desired wave simulations. It has been found, however, that substantial deviations from the 2:1 ratio may cause a centrally disposed circular balded area devoid of any substantial depth of water in the pool at optimum rotations. This condition is generally undesirable for safety reasons.

The speed is dependent on diameters of the pool which are normally between twenty and forty feet. Sufficient speeds are attained at 15-25 r.p.m.s. The flow of the body of water moves not from trough to crest but radially, across and perpendicular to the angle of the incline and in the direction of simulator rotation. As the surf rider alternates starboard and port surfcraft angularization against the centrifugally created radial flow he is able to bank up and down the centrifugally created inclined surface, thus successfully simulating the surfing sport within the simulator.

Figures 5, 6, 7, 8:
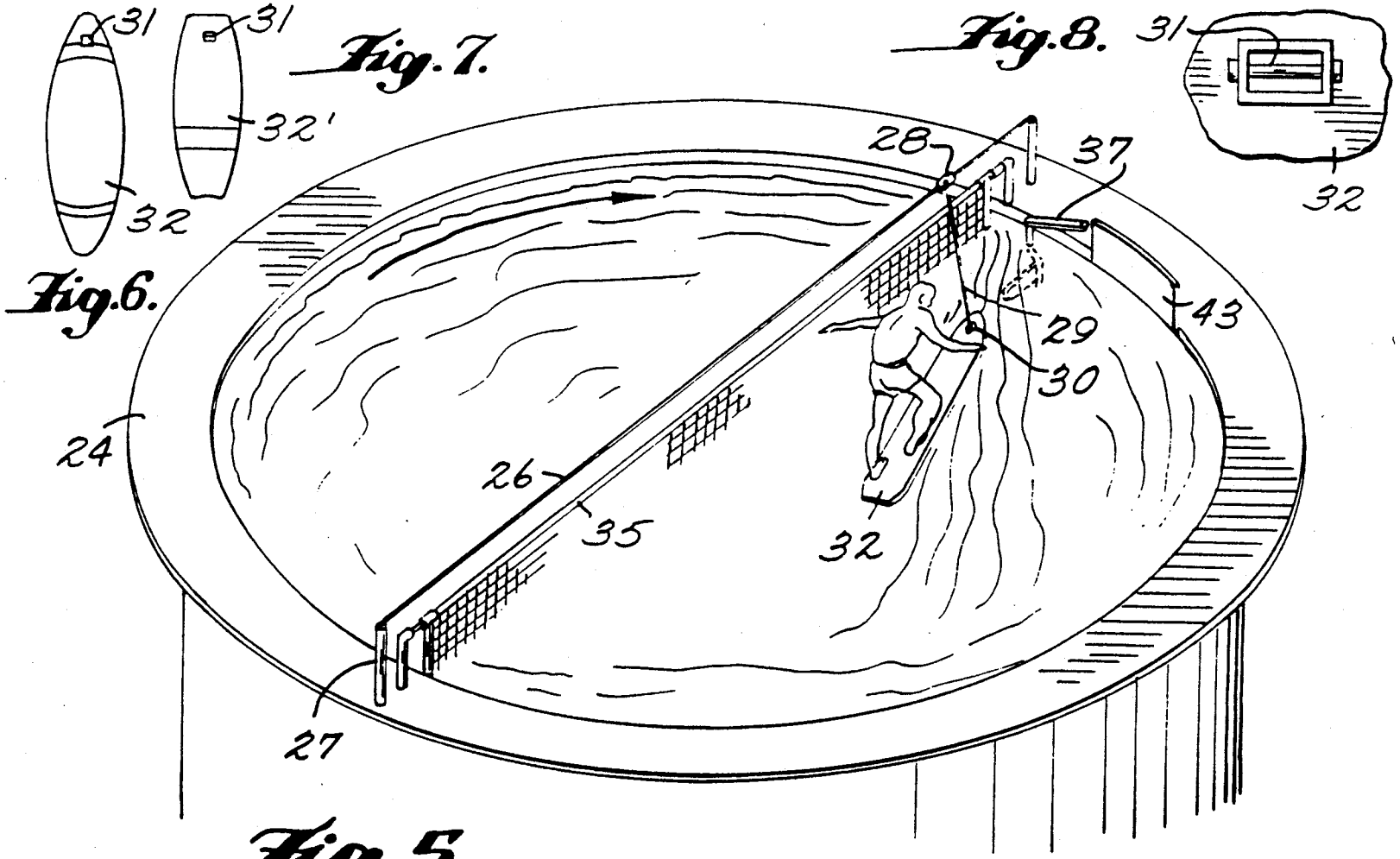
FIG. 5 is a perspective view of the simulator in operation.
FIGS. 6 and 7 are top views of surf craft used in conjunction with the device of the present invention.
FIG. 8 is an enlarged detail of the retaining pin taken in frontal cross-section from the surf craft shown in FIGS. 6 and 7.

To restrain movement of a surf craft and a rider which are both supported on the generated wave, a restraining wire 26, being of a length equal to or greater than the width of the pool and possessing the necessary tensile strength for rider support, is horizontally positioned across the length of the pool and affixed to the uppermost area of vertically disposed support posts 27. The posts are made of a material and length to enable support of restraining wire 26. Posts 27 are then bolted or otherwise secured, as shown, to raised pool deck 24. A roller mechanism 28, comprised of one or more bearing assemblies, or a similar device suitable to the purpose of 28, is secured to the restraining wire 26 in such a way so that it is allowed to move along the length of the wire without undue friction or resistance. A tether line such as retention leash 29 is provided and is made of nautical type rope or the like. Leash 29 has two ends and is of a length of between eight and fifteen feet. One end of the retention leash shall be clipped, knotted or otherwise affixed to roller mechanism 28 through a cleat or similar means while the other end of 29 is provided with a spring clip 30 or other quick attachment-/release device. A leash plug 31 is affixed to a predetermined position on the individual surf craft 32, 32', normally near the bow (nose) and centered flush upon the craft as shown in FIGS. 6-8. The exact measurements of surf crafts 32 and 32' are not critical as long as standard hydrodynamic principles are observed. Spring clip 30 then clamps onto the retention pin within 31. As the simulator becomes activated this system allows a surf rider to bank across the wave shaped flow created therein, with the juncture of 26, 27 and 28 acting as a kinetic pivot point for the surf rider, allowing a more dynamic range of motion than would be realized with a fixed and/or stationary anchoring of retention leash 29. Additionally, this system, in conjunction with the prolonged formation of a ridable wave-shaped flow as provided by the simulator, allows for surfing activity of a duration previously unattainable in or out of the ocean.

A net system is used for the entrance and exit of riders, and for the safe apprehension and subsequent exit of riders who "take a spill" while in the act of surfing the flow. Additional posts 27 are implemented to attach the net in a fixed position to the pool deck 24, with the addition of horizontal extension posts 33 which are affixed securely to the uppermost ends of their respective posts 27. Extending down from the ends of posts 33 are vertical net support posts 34 fashioned so as to be near flush with the rotating walls of the simulator. Safety stripping 25, similar to that used between the pool and the deck, is affixed between the post and simulator for similar safety reasons. Additionally, horizontal net support posts 35 extend across the pool and connect in similar fashion to the respective top and bottom ends of their diametrically opposite posts 34. All posts 27, 33, 34, and 35 utilize a tubular waterproof padding for safety, with individual posts 34 and 35 having apertures for the connecting of safety net 36, which is then positioned and affixed by well-known means across the length of the pool. Safety net 36 shall be made of a suitable material such as nylon webbing, water-proof fabric or the like. The net has eyes large enough to allow pool flow to continue unhindered yet small enough to hinder riders from becoming entangled or otherwise injured. Normally, the eyes of safety net 36 will therefore be between three and six inches.

A possible configuration would allow for many individuals to ride the simulator at once, i.e., multiple net systems may be deployed, thus creating individual web shaped safety zones within the pool. These zones, in conjunction with the implementation of additional transverse surf craft restraining means would allow several riders to surf the simulator at once.

With the net in place, a simulator rider may enter and exit the simulator in a safe manner, and if the rider has a fall or mishap while riding the wave flow he is carried by the flow into safety net 36. The rider may then exit the simulator by climbing up and out to the pool deck 24. Additionally, the rider can ensure additional safety to his person while utilizing the simulator by the donning of such protective gear as a helmet and a personal flotation device.

A crest baffle 37 may be employed to give the simulated wave flow specific shape and contour at the crest area. The purpose of the crest baffle is to aid the rider as he banks off of the crest shaped contour as is natural for indigenous surface riding in coastal areas. As seen in FIGS. 9-12 a baffle piece 38 is provided for this purpose. The piece is normally between one-half and two feet long and is constructed of a flat, rigid and preferably transparent material such as plastic or plexiglass. The baffle may be patterned in a rudder-like shape, as shown, or in other shaped pieces. Rectangular, oval, triangular or round shaped pieces may be employed with satisfactory results. In fact, a multiplicity of baffle pieces 38 in various shapes may be made available for rider use, the pieces attaching to an armature 39 by wing-nuts, spring pins or other means convenient for stable and speedy attachment of the baffle. It will be recognized by those skilled in the art that alternate multidimensional baffle structures may be implemented, encompassing complex hydrodynamically precise curvatures and/or linear conformations. A handle 40 is in turn fitted within the circumference of armature 39 and holes are provided near the mated rims of both the handle and armature for the introduction of at least one retaining pin 41. An additional pin 41' is positioned through a hole provided at the end of handle 40 for the purpose of anchoring the crest baffle 37 at a predetermined angle with respect to the pool deck 24 as shown. A multiplicity of slots are provided upon the pool deck for this purpose. Brackets 42 are bolted, welded or otherwise affixed to the vertically disposed circumferential area of pool deck 24 as shown and give the crest baffle 37 a solid pivot when the baffle is immersed in the rotary flow of the simulator.

The aforementioned system gives the advanced surf rider a choice of crest curvature and character upon which to perform maneuvers. Normally, crest baffle angularization between zero and thirty degrees creates a vertically disposed crest b', and between thirty and ninety degrees creates a tubing crest c', a phenomena wherein the crest throws out and forward from its point of origin thus creating a tubular partition of water within which the rider may test his skill. Additionally, from ninety to approximately one hundred and thirty degrees crest baffle 37 will form a jump wake, which is not unlike that formed by a boat's wake. This allows surf riders to perform aerial maneuvers thereon. A reversal of the baffle piece on its armature is used to form the jump wake at ninety to one hundred thirty degrees.

Optimally, the invention will be capable of clockwise and counter-clockwise rotation for the successful simulation of both right- and left-breaking waves. Therefore, in the event that such a reversed rotation is desired, baffle piece 38 would be removed from armature 39, reversed in position and reaffixed to 39. It is the flat and symmetrical nature of 38 that shall make this adaptation for reverse rotation position possible.

The crest baffle is optimally for use in crest enhancement primarily for the riding thereon by seasoned surf riders, with novices having the system removed for safety purposes. The simulator's centrifugally created wave flow may of course be ridden successfully without the deployment of crest baffle 37. Thus, the non-breaking and turbulence-free wave shaped flow is created which is well-suited for riding by beginners.

Splash guards 43, being preferably constructed of similar material as baffle piece 38, may be predisposed as shown for retaining water spray within the simulator which normally results from a banking by advanced riders off of the aforementioned crest portion of the wave shaped flow.

A control panel (not shown) is provided for simulator operation, with individual controls primarily for the acceleration and braking of the simulator. Other monitoring instruments, such as those normal as to the gauging of R.P.M's, flow rate and for the altering of rotational direction, etc., may be provided as deemed necessary.

Additionally, appropriate water filtration and purification means may be employed for hygienic safety, with the hardware for such devices adapted to the rotational nature of the simulator.

Although the present invention has been described in connection with preferred embodiments, it will be appreciated by those skilled in the art that additions, modifications, substitutions and deletions not specifically described may be made without departing from the spirit and scope of the invention defined in the appended claims.

We claim:

1. A rotatable surfing simulator comprising:

a container, open at the top for holding a body of water of sufficient volume to support a surf craft and rider thereon;

means for rotating said container in a given direction of rotation so as to rotate the body of water therewith in said direction of rotation, at a speed which generates an inclined surface of the body of water; and means for restraining movement in said direction of rotation of a surf craft and rider supported on said inclined surface.

2. A rotatable surfing simulator as defined in claim 1, wherein said drive means comprises a drive wheel mounted on a rotatable shaft and a motor for rotating said shaft, said drive wheel being in contact with and driving said container.

3. A rotatable surfing simulator as defined in claim 1, wherein said container rests on a platform and said means for rotating said container rotate the platform, said platform comprising a plurality of portions hinged to one another.

4. A rotatable surfing simulator as defined in claim 1, wherein said means for restraining movement comprises a stationary object and connecting means connecting said surf craft to said object such that said surf craft does not rotate with said container.

5. A rotatable surfing simulator as defined in claim 1, wherein a safety net is stationarily positioned within said container so as to capture an object caught in the flow of rotating water upon rotation of the container.

6. A rotatable surfing simulator as defined in claim 1, further comprising a stationary deck surrounding said container and configured so as not to interfere with rotation of said container.

7. A rotatable surfing simulator as in claim 6, wherein a baffle is provided mounted to said stationary deck for altering the flow of water when a volume of water is disposed within said container and said container is rotating.

8. A rotatable surfing simulator as defined in claim 7, wherein said baffle is positionable between various positions to alter the flow of water in various fashions.

9. A rotatable surfing simulator as defined in claim 5, wherein said safety net extends to a point adjacent the bottom of the container and extends between diametrically opposite portions of the container substantially all the way across the bottom of said container.

10. A rotatable surfing simulator as defined in claim 4, wherein said surf craft is connected to a transverse restraining means.

11. A rotatable surfing simulator as defined in claim 10, wherein said restraining means is a restraining wire.

12. A rotatable surfing simulator as defined in claim 10, wherein said restraining means is diametrically disposed above said container.

13. A rotatable surfing simulator as defined in claim 9, further comprising a transverse restraining means which is substantially parallel to said safety net.

14. A rotatable surfing simulator as defined in claim 13, wherein said restraining means is disposed above said net.

15. A rotatable surfing simulator as defined in claim 10, further comprising a roller mechanism secured to said connecting means and movable along said transverse restraining means so as to provide a transversely movable connection between said surf craft and said transverse retraining means.

16. A rotatable surfing simulator as defined in claim 10, wherein a tether line is secured from said restraining means to a surf craft.

17. A rotatable surfing simulator as defined in claim 13, wherein a baffle is provided mounted to a stationary deck around said container for altering the flow of water, said baffle extending into said water adjacent said net and restraining means.

18. A rotatable surfing simulator as defined in claim 17, wherein said baffle is positioned downstream of a water flow relative to said net.

19. A method of simulating surfing comprising:

providing a container having a body of water disposed therein sufficient to support a surf craft and rider thereon;

rotating said container in a given direction of rotation so as to rotate the body of water therewith in said direction of rotation at a speed sufficient to form an inclined surface of said body of water such that the water is deeper at an outer portion of said container than at an inner portion; and restraining movement in said direction of rotation of a surf craft and rider supported on said inclined surface.

20. A method as defined in claim 19, further comprising positioning a stationary baffle, which does not rotate with said pool, within said flow of water to alter said flow of water.

21. A rotatable surfing simulator comprising:

a container, open at the top for holding a body of water of sufficient volume to support a surf craft and rider thereon, said container having a circumference and a radius;

means for rotating said container in a circumferential direction of rotation so as to rotate the body of water therewith in said circumferential direction, at a speed which generates an inclined surface of the body of water; and means for restraining movement in said circumferential direction and permitting free movement in a radial direction of a surf craft and rider supported on said inclined surface.

22. A rotatable surfing simulator as defined in claim 21, wherein a safety net is stationarily positioned within said container so as to capture an object caught in the flow of rotating water upon rotation of said container.

23. A rotatable surfing simulator as defined in claim 21, further comprising a stationary deck surrounding said container and configured so as not to interfere with rotation of said container.

24. A rotatable surfing simulator as defined in claim 23, wherein a baffle is provided mounted to said stationary deck for altering the flow of water when a volume of water is disposed within said container and said container is rotating.

25. A rotatable surfing simulator as defined in claim 24, wherein said baffle is positionable between various positions to alter the flow of water in various fashions.

26. A rotatable surfing simulator as defined in claim 22, wherein said safety net extends between diametrically opposite portions of the container substantially all the way across the bottom of said container.

27. A method as defined in claim 19, wherein said container has a circumference and a radius and wherein said direction of rotation is a circumferential direction and said step of restraining movement is for restraining movement in said circumferential direction, said method permitting free movement in a radial direction of a surf craft and rider supported on said inclined surface.

* * * * *